US005309678A

United States Patent [19]

Adachi

[11] Patent Number: 5,309,678

[45] Date of Patent: May 10, 1994

[54] TENSION ADJUSTING APPARATUS

[75] Inventor: Tadashi Adachi, Aichi, Japan

[73] Assignee: Asmo Co., Ltd., Japan

[21] Appl. No.: 824,242

[22] Filed: Jan. 21, 1992

[30] Foreign Application Priority Data

Apr. 22, 1991 [JP] Japan ..... 3-090618

[51] Int. Cl.[5] ..... E05F 11/48

[52] U.S. Cl. ..... 49/352

[58] Field of Search ..... 49/348, 349, 352

[56] References Cited

U.S. PATENT DOCUMENTS

| | | | |
|---|---|---|---|
| 1,218,130 | 3/1917 | Ternstedt | 49/352 |
| 4,004,371 | 1/1977 | Podolan et al. . | |
| 4,095,370 | 6/1978 | Muehling . | |
| 4,109,417 | 8/1978 | Fogarollo | 49/352 |
| 4,637,166 | 1/1987 | Ujihara | 49/352 |
| 4,663,886 | 5/1987 | Nakamura et al. | 49/352 X |
| 4,691,475 | 9/1987 | Maekawa | 49/349 X |
| 4,823,512 | 4/1989 | Maekawa et al. | 49/352 |
| 4,922,783 | 5/1990 | Wallace | 49/352 |
| 5,022,184 | 6/1991 | Yamamura et al. . | |

FOREIGN PATENT DOCUMENTS

| | | | |
|---|---|---|---|
| 581285 | 7/1933 | Fed. Rep. of Germany | 49/352 |
| 1275878 | 11/1989 | Japan . | |
| 2087973 | 6/1982 | United Kingdom | 49/352 |

*Primary Examiner*—Peter M. Cuomo
*Assistant Examiner*—Jerry Redman
*Attorney, Agent, or Firm*—Venable, Baetjer, Howard & Civiletti

[57] ABSTRACT

A tension adjusting apparatus comprising a coupling device for movably coupling both ends of an elongated member disposed in the shape of a loop in a direction in which both ends approach and/or move apart from each other along the longitudinal direction of the elongated member, and an urging member retained by the coupling device and for urging the elongated member via the coupling device in a direction in which both ends of the elongated member approach to each other in order to apply tension to the elongated member, The smooth movement of the elongated member transmitting motive power and the tension of the elongated member at a predetermined value are thereby maintained without impeding the durability of the elongated member.

18 Claims, 6 Drawing Sheets

TENSION ADJUSTING APPARATUS

BACKGROUND OF THE INVENTION

1. Field of the Invention

The present invention relates to a tension adjusting apparatus and more particularly relates to a tension adjusting apparatus which can maintain the tension of an elongated member at a predetermined value. One end of the elongated member in its longitudinal direction and the other end are connected with each other so as to be disposed in the shape of a loop so that motive power can be transmitted thereby.

2. Description of the Related Art

Various types of motive power transmission mechanisms are well known for moving a member to be moved by transmitting motive power to the member through a loop-shaped or endless elongated member whose one end in its longitudinal direction and other end are connected with each other.

For example, with respect to a window regulator for opening and closing window glasses of a vehicle, the prior art discloses a mechanism wherein a driving source such as a motor is connected to a window glass by means of an endless wire or flexible tape. Torque of the motor is transmitted to the glass through such a wire or tape so that the window glass can be raised or lowered. Such a window regulator using a wire driving system has advantages over a well-known x-arm type window regulator in that it is lightweight, the degrees of freedom for installation thereof can be increased, and it has a wide range of applications.

However, in the above-described motive power transmission mechanism using an endless elongated member such as wire or flexible tape, it is necessary to continuously remove looseness from the endless elongated member and maintain the tension thereof at a predetermined value since the motive power cannot be transmitted properly when the endless elongated member is loose. Therefore, a mechanism for preventing looseness of an endless elongated member therefor (a tension adjusting apparatus) has been already proposed which is disclosed in U.S. Pat. No. 5,022,184 corresponding to Japanese Patent Application Laid-open No. 1-275878.

This mechanism for preventing looseness of an endless elongated member is such that a tension coil spring (tension applying member) is suspended between portions facing each other of a tape via tape guides. The spring always urges the tape in the direction in which the portions approach to each other. Thus, even if the tape is about to loosen, it is instantly stretched by means of the tension coil spring, so that the tension of the tape can be maintained at a predetermined value without generating looseness therein. As a result, this allows motive power to be reliably transmitted via the tape.

However, in the above-described mechanism for preventing looseness of an endless elongated member, a tension coil spring suspended over a tape, namely, a tape guide slides and touches the tape while the tape is moved. The frictional resistance therein is increased, thereby preventing a smooth movement of the tape. In addition, this causes wear of the tape and/or tape guide and degradation of the durability thereof.

SUMMARY OF THE INVENTION

Taking into account the above-mentioned facts, it is an object of the present invention to provide a tension adjusting apparatus which can maintain the tension of an elongated member at a predetermined value by its simple construction without preventing movement of the elongated member transmitting a motive power and decreasing the durability thereof, and which has a wide range of applications.

Therefore, according to the present invention, a tension adjusting apparatus for applying tension to an elongated member whose one end in its longitudinal direction and other end are connected with each other so that the elongated member is disposed in the shape of a loop and move in the shape of a loop, is set forth. This tension adjusting apparatus comprises a coupling member for movably coupling the one end of the elongated member to the other end in a direction in which they approach to each other and/or a direction in which they move apart from each other along the longitudinal direction of the elongated member, and an urging member retained by the coupling member and for urging the elongated member via the coupling member in the direction in which the one end and the other end of the elongated member approach to each other in order to apply tension to the elongated member.

The tension is applied to the elongated member by means of urging force of the urging member retained in a predetermined position by the coupling member. In such a case, when the tension of the elongated member is about to change due to the looseness therein, the member is instantly stretched by the urging member and is moved in a direction in which both ends of the member approach to each other. Thus, the tension of the elongated member can be maintained at a predetermined value due to the urging member without any looseness being generated therein. As a result, this causes motive power to be reliably transmitted via the elongated member, and a member to be moved which is secured to the coupling member, can be moved assuredly.

In these circumstances, since the urging member is retained on the coupling member and is moved together with the elongated member, there is no possibility that the urging member slides and interferes with the member as it is moved. Accordingly, this removes frictional resistance therein, prevents wear of the elongated member and also improves the durability thereof.

DESCRIPTION OF THE PREFERRED EMBODIMENTS

Figure 3:
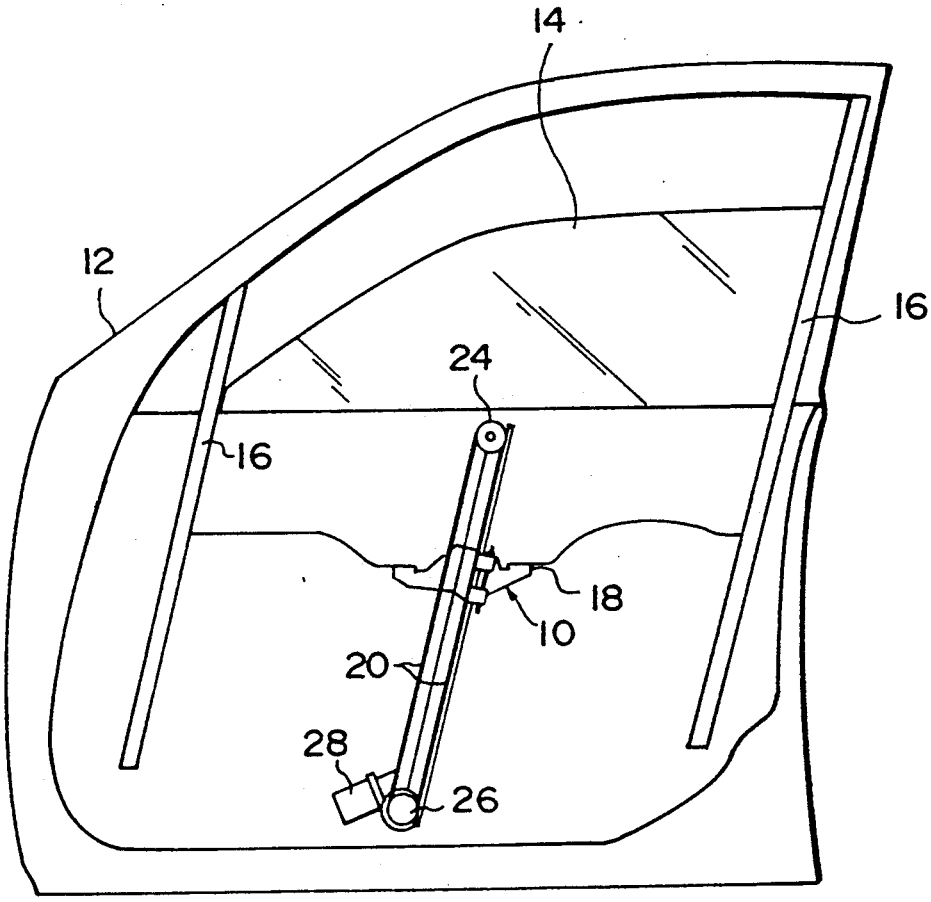
FIG. 3 shows a schematic general construction of a power window device for a vehicle door to which the tension adjusting apparatus of this invention is applied.

Referring now to FIG. 3, there is shown a schematic general construction of a power window device for a vehicle door to which a tension adjusting apparatus of the present invention may be applied.

A window glass 14 of a door 12 is slidably supported at its front end and back end along the longitudinal direction of a vehicle by door frames 16 which are arranged along the vertical direction of the door 12 and which face and are parallel to each other. A bracket 18 is secured to the lower end portion of the window glass 14, and further, the bracket 18 is coupled to a tape 20 which serves as an elongated member.

Figure 2:
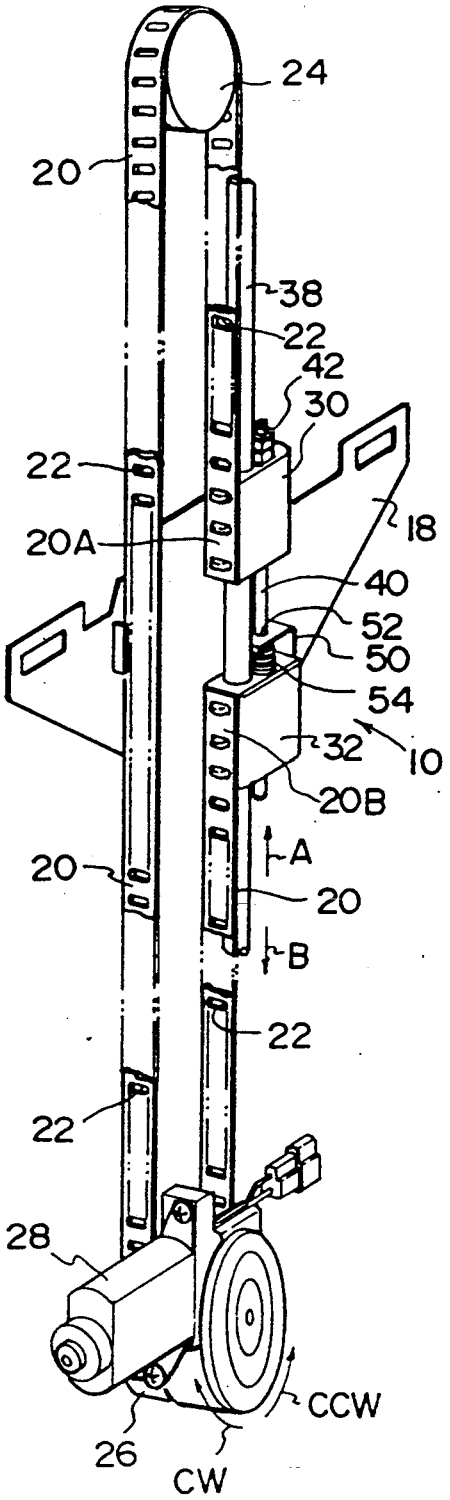
FIG. 2 is a perspective view of the tension adjusting apparatus according to the present invention.

The tape 20, comprising a flexible material and made from resin or metal, is provided with rectangular perforations 22, equally spaced and successively formed along the entire length thereof as shown in FIG. 2. The tape 20 is trained over sprockets 24 and 26 as a rotational engaging body, each of whose axes is located in a substantially horizontal plane at the upper and lower portions of the door 12, respectively. The lower sprocket 26 is connected to a motor 28, which serves as a driving source, via a deceleration mechanism (not shown) and is rotated by the motor 28.

Figure 1:
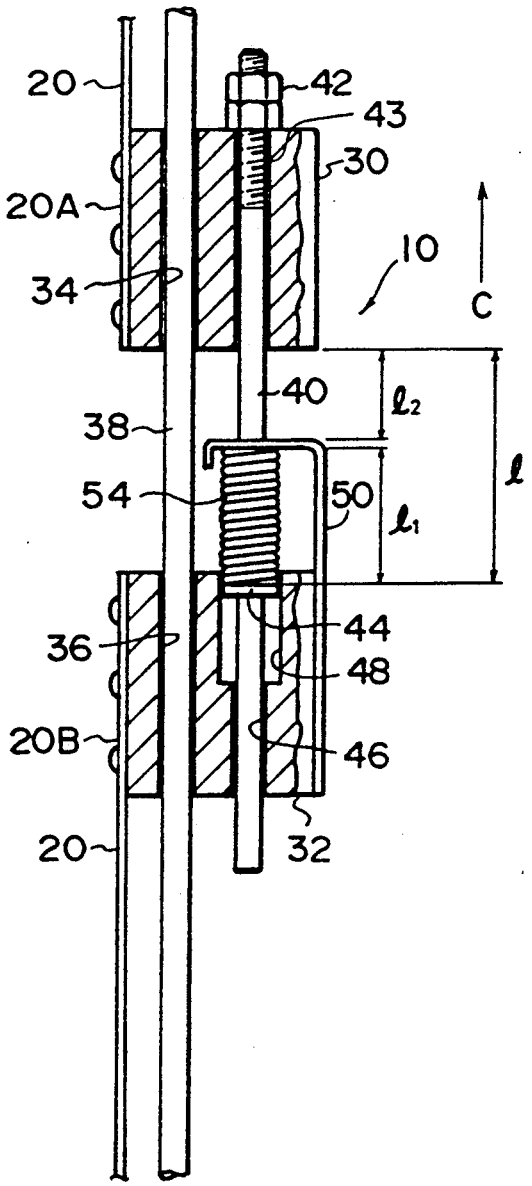
FIG. 1 is a sectional view of a tension adjusting apparatus according to the present invention.

As illustrated particularly in FIGS. 1 and 2, one end 20A in the longitudinal direction of the tape 20 and the other end 20B are each fixedly provided with block-shaped sliders 30 and 32 for forming a coupling means. Further, the slider 30 is provided with the above-described bracket 18. Thus, the bracket 18 is always moved together with the slider 30. The sliders 30 and 32 are each provided with through holes 34 and 36 respectively, through which a guide pole 38 passes in free relative motion. The guide pole 38 is arranged parallel to a moving locus of the window glass 14, and the upper and the lower ends of the guide pole 38 are secured to the door 12. The guide pole 38 may be replaced with a guide rail.

A through shaft 40 penetrates into the upper slider 30. The through shaft 40 is provided with thread grooves 43 between an intermediate portion of the penetration section and the one end. The thread grooves 43 are engaged with a double nut 42, by which movement of the slider 30 in the direction of arrow C (FIG. 1) is limited. Adjusting the double nut 42 permits the engaging position to be changed in an axial direction of the through shaft 40. A support piece 44 is fixed integrally with the through shaft 40 in the middle portion in the axial direction thereof.

In the meantime, the lower slider 32 is provided with a through hole 46 corresponding to the through shaft 40 which is secured to the slider 30. The through shaft 40 passes through the through hole 46. The internal diameter of the through hole 46 at its one end toward the slider 30 is extended so as to be formed into an enlarged diameter portion 48, inside which the support piece 44 of the through shaft 40 can be freely inserted and released. In addition, the slider 32 is fixedly provided with a stopper 50. The substantially L-shaped stopper 50 is attached opposite to a fixed portion of the tape 20 (the other end 20B) on the slider 32 so that an end portion of the L shape protrudes toward the slider 30. Further, the end portion of the L shape (stopper 50) is provided with a through hole 52 through which a middle portion of the through shaft 40 passes.

A tension coil spring 54, serving as an urging member, is positioned between the stopper 50 fixed to the slider 32 and the support piece 44 of the through shaft 40. The tension coil spring 54 is constructed such that its overall length L in a natural condition is longer than a distance 1 between the slider 30 and the support piece 44. The spring 54 is posed between the stopper 50 and the support piece 44 in its fully compressed condition. Therefore, the tension coil spring 54 continuously urges the stopper 50, i.e., the slider 32, in a direction of the slider 30 and similarly urges the through shaft 40, i.e., the slider 30, in a direction of the slider 32. The above-described construction enables a connection between one end 20A of the tape 20 and the other end 20B so as to be disposed in the shape of a loop.

Next, the operation of the present embodiment of this invention is explained below.

In accordance with a power window device for a vehicle door to which the above-mentioned tension adjusting apparatus 10 is applied, the urging force of the tension coil spring 54 retained between the stopper 50 and the support piece 44 of the through shaft 40, is applied to the slider 30, i.e., one end 20A of the tape 20, and the slider 32, i.e., the other end 20A of the tape 20, in a direction in which both ends approach to each other, thereby applying a predetermined tension to the tape 20.

When the motor 28 is actuated in the forward and/or backward direction in order to raise and lower the window glass 14, the rotating force of the motor 28 is transmitted to the tape 20 through the sprocket 26, and the tape 20 is stretched. For example, when the window glass 14 is raised, the sprocket 26 rotates in the direction of arrow CCW in FIG. 2 and the tape 20 is stretched and moved in the direction of arrow A. On the other hand, when the window glass 14 is lowered, the sprocket 26 rotates in the direction of arrow CW in FIG. 2 and the tape 20 is stretched and moved in the direction of arrow B. This movement of the tape 20 causes the bracket 18 fixedly connected to the slider 30 to be moved together with the tape 20, resulting in the vertical movement of the window glass 14 between its open and closed positions along the door frames 16.

In this case, since these sliders 30 and 32 both are guided by and moved along the guide pole 38, the tape 20 and the bracket 18 are reliably transferred along a fixed locus. Further, since the tension coil spring 54 is retained between the stopper 50 secured to the slider 32 and the support piece 44 of the through shaft 40 and is moved together with the tape 20 and the bracket 18 (i.e., the window glass 14), there is no possibility that the tension coil spring 54 slides and interferes with the tape 20 and/or the bracket 18 during the movement of the tape. This does not cause frictional resistance, prevents the tape 20 from being worn, and also improves the durability of the tape. As a result, in this power window device, power loss is only generated by the rotation axis of the sprocket 24 and by the sliding portion of the slider 30 and the guide pole 38. Thus, a highly efficient system can be achieved which can overcome any conventional system by far.

In such a case that the tension of the tape 20 is about to change due to looseness therein, the stopper 50, i.e., the slider 32, is moved closely toward the slider 30, and the through shaft 40, i.e., the slider 30, is moved closely toward the slider 32 by means of the urging force by which the tension coil spring 54 is about to spring back to its overall length in the natural condition. Therefore, the tape 20 is instantly stretched and moved in the direction in which its one end 20A and other end 20B approach to each other. As a result, the tension of the tape 20 can be maintained at a predetermined value during installation or assembly (setting) without any looseness being generated therein. This allows motive power to be reliably transmitted by way of the tape 20 and also allows the bracket 18, i.e., the window glass 14, to be moved assuredly.

The tension adjusting load T of the tape 20 due to an urging force of the tension coil spring 54 can be expressed in the following formula:

$$T=k(L-l_1)$$

where,

L is an overall length of the tension coil spring 54 in its natural condition (free length);

l is a distance between the slider 30 and the support piece 44 during installation or assembly (setting);

$l_1$ is a length of the tension coil spring 54 in its fully compressed condition;

k is a spring constant of the tension coil spring 54.

Further, a looseness removal range of the tape 20 due to the tension coil spring 54 is indicated as a distance $l_2$ between the slider 30 and the stopper 50 as shown in FIG. 1. The construction is such that the looseness in the tape 20 is directly removed along the winding direction of the tape 20 (longitudinally). Therefore, this system is superior to the prior art mechanism for preventing looseness of the tape by reducing a distance between facing ends of the tape 20, in regard to the tension adjusting function and in so far as the adjustable range is wide.

Further, since the engaging position of the through shaft 40, retaining the tension coil spring 54, with the slider 30 along the axial direction thereof can be changed by adjusting the double nut 42, a retaining position of the tension coil spring 54 can easily be changed when the engaging position of the through shaft 40 is changed. Consequently, by changing the engaging position of the through shaft 40 with the slider 30 according to a length of the tape 20 and an overall length and an urging force of the tension coil spring 54, a desired tension value can easily be set, and the applicability of this system can be extended.

Figure 5:
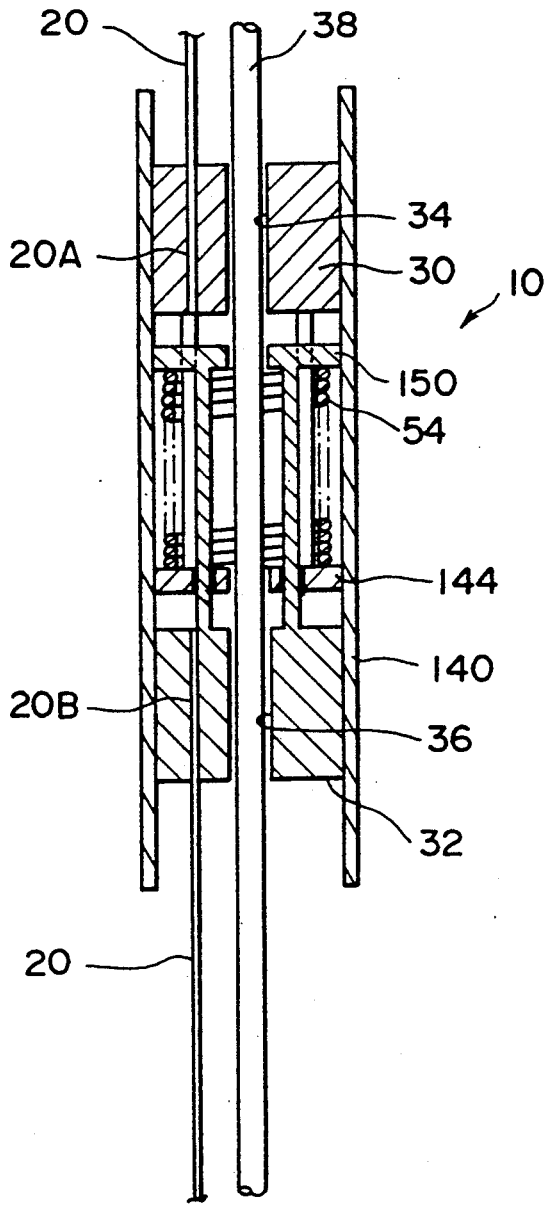
FIG. 5 is a sectional view of a tension adjusting apparatus in which a cylindrical member is used according to modification of the present invention.
Figure 6:
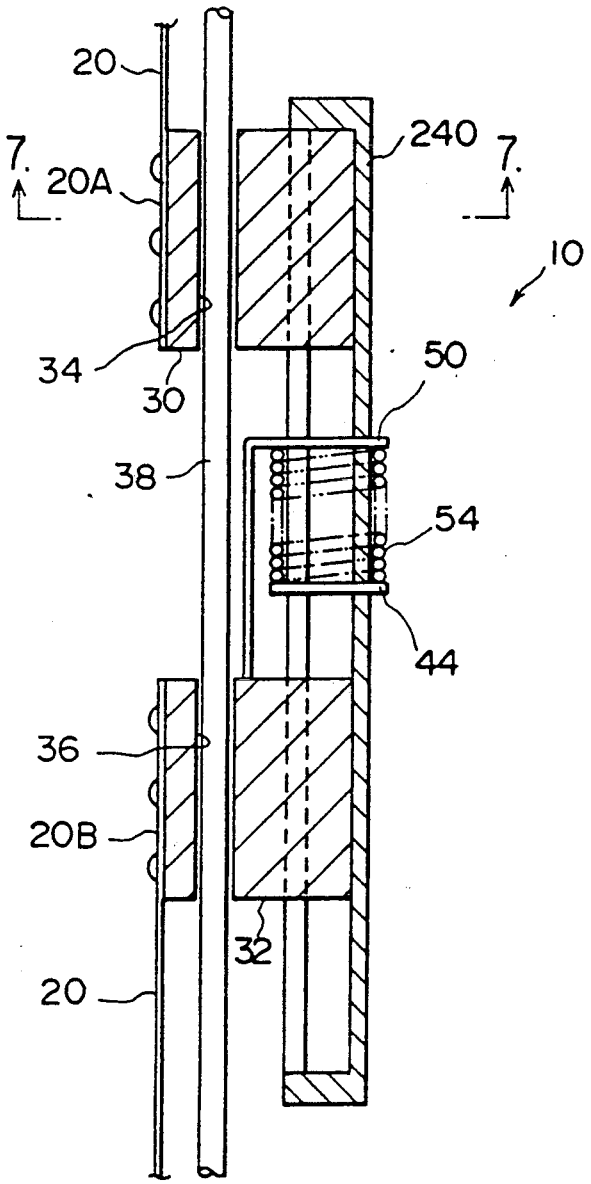
FIG. 6 is a sectional view of a tension adjusting apparatus in which a rail member is used according to modification of the present invention.
Figure 7:
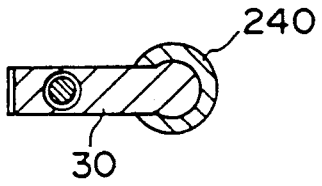
FIG. 7 is a sectional view taken along the line 7—7 of FIG. 6.

Although the present embodiment of this invention has described a construction in which the through shaft 40 penetrates into sliders 30 and 32, any cylindrical member 140 for accommodating the sliders 30 and 32 as a supporting member may be used with a supporting plate 144 and a stopper 150 as shown in FIG. 5, or any rail member 240 along which the sliders 30 and 32 are moved may be used as shown in FIGS. 6 and 7, in place of the through shaft 40 in order to movably support these sliders 30 and 32.

Figure 4:
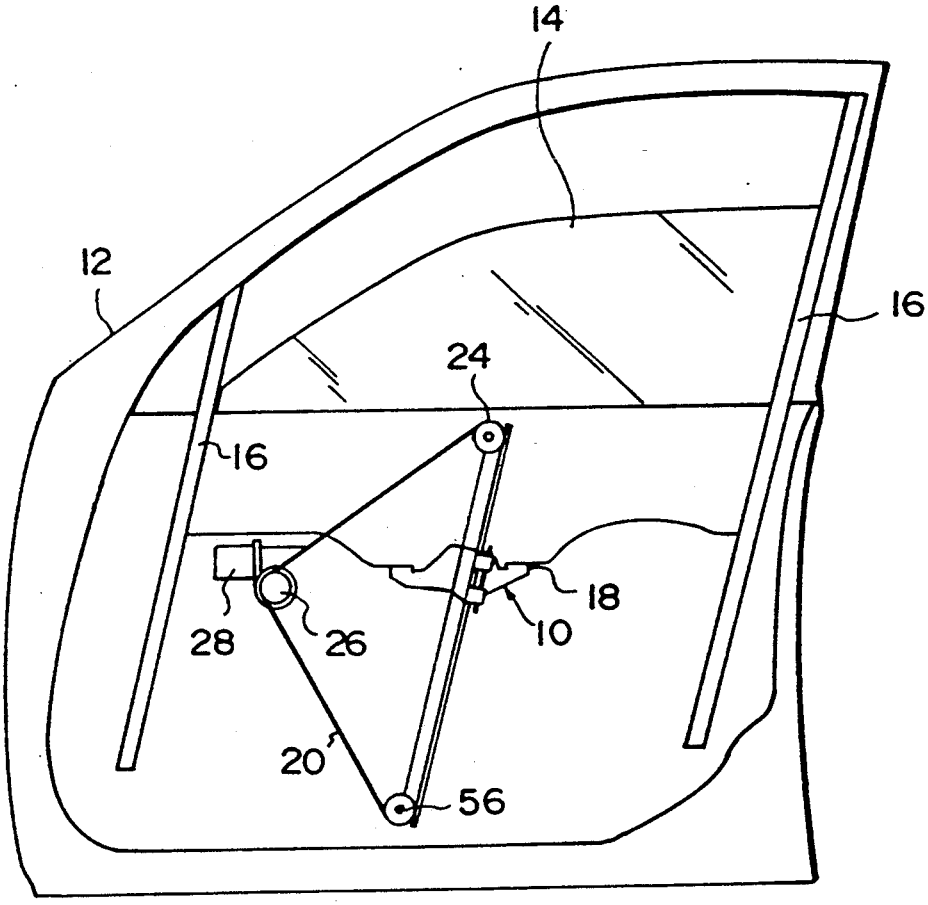
FIG. 4 shows a schematic general construction of an alternate embodiment of a power window device for a vehicle door to which the tension adjusting apparatus of this invention is applied.

Further, although the present embodiment of this invention is constructed so that the tape 20 is trained over a pair of sprockets 24, 26, it is not limited to this construction. A construction in which the tape is trained over three or more sprockets is also acceptable. For example, as shown in FIG. 4, by transferring the positions of the motor 28 and the sprocket 26 in the door 12 to the front side of the vehicle and by mounting an additional sprocket 56 to a power window device, the tape 20 may be trained over the three sprockets 24, 26 and 56. This configuration allows the location of the installation of the motor 28 to be freely selected, thus extending the range of choices of the loading position of a power window device.

Also according to the present invention, an embodiment in which the tension adjusting apparatus 10 is applied to a power window device for vehicle window has been described herein, but the apparatus 10 may also be applied to a manually operated window regulator for a vehicle door. In such a case, an alternative embodiment using three sprockets can be easily applied to the manually operated window regulator. Even in this case, the bracket 18 (the window glass 14) can be moved together with the tape 20, and the tension of the tape 20 can be maintained at a predetermined value without any looseness being generated therein, thereby causing the motive power to be reliably transmitted through the tape 20.

Further, although the present embodiment of this invention describes a case in which the tension adjusting apparatus 10 is applied to the tape 20 of a power window device for a vehicle door, the present invention is not limited to such a construction. It can easily be applied to any other construction and/or mechanism if there is a need to maintain, at a predetermined value, the tension of an elongated member, such as wire or tape, disposed in the shape of a loop and transmitting motive power.

As described above, the tension adjusting apparatus according to the present invention has advantages in that it can maintain the tension of an elongated member at a predetermined value by means of its simple construction without preventing a movement of the elongated member transmitting motive power or decreasing the durability thereof, and in that it has a wide range of applications.

What is claimed is:

1. A tension adjusting apparatus for applying tension to an elongated member having a first end and a second end that are connected together such that the elongated member is substantially in the shape of a loop and is movable along a locus defined by the loop, comprising:

coupling means for movably coupling the first end of the elongated member to the second end of the elongated member such that said first end and said second end may move toward each other and/or apart in a longitudinal direction of the elongated member; and urging means, retained by said coupling means, for urging at least one of said first end and said second end of said elongated member toward the other end, said urging means producing an urging force in order to urge at least one of said first and second ends of said elongated member;

wherein said coupling means comprises a pair of fastening members to which the first end and the second end of said elongated member are fastened, respectively, and an elongated supporting member coupled to said fastening members such that said fastening members are movable with respect to said supporting member in a direction of elongation of said supporting member and wherein one of said fastening members is provide with a stopper member extending therefrom, said supporting member includes a protruding portion, and said urging means is disposed between a portion of said stopper member and said protruding portion of said supporting member such that said urging means urges said one of said fastening members, via the stopper member, toward the other of said fastening members.

2. A tension adjusting apparatus according to claim 1, wherein said supporting member penetrates each said fastening member, thereby supporting said fastening members.

3. A tension adjusting apparatus according to claim 1, wherein said supporting member accomodates each said fastening member, thereby supporting said fastening members.

4. A tension adjusting apparatus according to claim 1, wherein said supporting member comprises a rail that supports said fastening members such that at least one of said fastening members movably engages said rail.

5. A tension adjusting apparatus according to claim 1, wherein said urging means is operable to urge at least one of said fastening members toward the other of said pair of fastening members.

6. A tension adjusting apparatus according to claim 1, wherein said coupling means further comprises means for limiting the movement of at least one of said fastening members away from the other of said fastening members.

7. A tension adjusting apparatus according to claim 1, further comprising a guide member coupled to said coupling means for guiding the movement of said coupling means as said elongated member moves along said locus.

8. A tension adjusting apparatus according to claim 1, further comprising a connecting member attached to said coupling means for connecting a member for movement with said coupling means.

9. A window regulator for raising and lowering a vehicle window, comprising:

a plurality of rotatable engaging bodies;

an elongated member having a first end and a second end that are connected together, said elongated member being wrapped around said rotatable engaging bodies such that said elongated member is disposed in the shape of a loop, wherein rotation of at least one of said rotatable engaging bodies causes said elongated member to move along a locus defined by the loop;

a pair of fastening members to which the first end and the second end of said elongated member are fastened, respectively;

a supporting member coupled to said fastening members such that said fastening members are movable with respect to said supporting member, toward and away from each other, said supporting member providing guidance for said fastening members when said fastening members move;

a retaining member for retaining the vehicle window, said retaining member being fixed to one of said fastening members such that said retaining member moves with said one of said fastening members; and an urging member retained by said supporting member and one of said fastening members, said urging member urging at least one of said fastening members toward the other fastening member, thereby maintaining a tension of said elongated member at a predetermined value wherein one of said fastening members is provide with a stopper member extending therefrom, said supporting member includes a protruding portion, and said urging means is disposed between a portion of said stopper member and said protruding portion of said supporting member such that said urging means urges said one of said fastening members, via the stopper member, toward the other of said fastening members.

10. A window regulator according to claim 9, wherein said supporting member penetrates each said fastening member, thereby supporting said fastening members.

11. A window regulator according to claim 9, wherein said supporting member accommodates each said fastening member, thereby supporting said fastening members.

12. A window regulator according to claim 9, wherein said supporting member comprises a rail that supports said fastening members such that at least one of said fastening members movably engages said rail.

13. A window regulator according to claim 9, further comprising means for limiting the movement of at least one of said fastening members away from the other of said fastening members, said means for limiting the movement being disposed adjacent said at least one of said fastening members.

14. A window regulator according to claim 13, wherein said urging member is disposed adjacent to and acts on said other of said fastening members to urge said other of said fastening members to move to urge toward said at least one of said fastening members.

15. A window regulator according to claim 9, further comprising a guide member coupled to said coupling means for guiding the movement of said coupling means as said elongated member moves along said locus.

16. A window regulator according to claim 9, wherein at least three rotatable engaging bodies are provided.

17. A tension adjusting apparatus for applying tension to an elongated member having a first end and a second end that are connected together such that the elongated member is substantially in the shape of a loop and is movable along a locus defined by the loop, comprising:

coupling means for movably coupling the first end of the elongated member to the second end of the elongated member such that said first end and said second end may move together and/or apart in a longitudinal direction of the elongated member; and urging means, retained by said coupling means, for urging at least one of said first end and said second end of said elongated member toward the other end, said urging means producing an urging force in order to urge said at least one of said first and second ends of said elongated member;

wherein said coupling means comprises a pair of fastening members to which the first end and the second end of said elongated member are fastened, respectively, and a supporting member supportingly coupled to said fastening members such that said pair of fastening members are capable of being urged toward and apart from each other as said elongated member moves;

wherein said coupling means further comprises means for limiting the movement of at least one of said fastening members away from the other of said fastening members; and wherein one of said pair of fastening members is provided with a hook-shaped member extending therefrom, said supporting member includes a centrifugally protruding portion, and said urging means is disposed between said hooked-shaped member and said protruding portion of said supporting member such that said urging means urges said one of said fastening members, via the hooked-shaped member, toward the other of said pair of fastening members.

18. A window regulator for raising and lowering a vehicle window, comprising:

a plurality of rotatable engaging bodies;

an elongated member having a first end and a second end that are connected together, said elongated member being wrapped around said rotatable engaging bodies such that said elongated member is disposed in the shape of a loop, wherein rotation of at least one of said rotatable engaging bodies causes said elongated member to move along a locus defined by the loop;

a pair of fastening members to which the first end and the second end of said elongated member are fastened, respectively;

a supporting member coupled to said fastening members such that said fastening members are movable with respect to said supporting member, toward and away from each other, said supporting member providing guidance for said fastening members when said fastening members move;

a retaining member for retaining the vehicle window, said retaining member being fixed to one of said fastening members such that said retaining member moves with said one of said fastening members;

an urging member retained by said supporting member and one of said pair of fastening members, said urging member urging at least one of said pair of fastening members toward the other fastening member, thereby maintaining a tension of said elongated member at a predetermined value; and means for limiting the movement of at least one of said fastening members away from the other of said fastening members, said means for limiting the movement being disposed adjacent said at least one of said fastening members;

wherein said urging member is disposed adjacent to and acts on said other of said fastening members to urge said other of said fastening members toward said at least one of said fastening members; and wherein one of said fastening members is provided with a hook-shaped member extending therefrom, said supporting member includes a centrifugally protruding portion, and said urging means is disposed between said hooked-shaped member and said protruding portion of said supporting member such that said urging means urges said one of said fastening members, via the hooked-shaped member, toward the other of said fastening members.

* * * * *